US012048326B2

(12) United States Patent
Du et al.

(10) Patent No.: US 12,048,326 B2
(45) Date of Patent: Jul. 30, 2024

(54) ELECTRONIC CIGARETTE AND CARTRIDGE FOR AN ELECTRONIC CIGARETTE

(71) Applicant: JT International S.A., Geneva (CH)

(72) Inventors: Kun Du, Shenzhen (CN); YanZhou Huang, Shenzhen (CN); GuangPing Cao, Shenzhen (CN); ShengJie Hu, Shenzhen (CN); YunShan Ma, Shenzhen (CN)

(73) Assignee: JT International S.A. (CH)

( * ) Notice: Subject to any disclaimer, the term of this patent is extended or adjusted under 35 U.S.C. 154(b) by 560 days.

(21) Appl. No.: 17/416,219

(22) PCT Filed: Dec. 20, 2019

(86) PCT No.: PCT/EP2019/086848
§ 371 (c)(1),
(2) Date: Jun. 18, 2021

(87) PCT Pub. No.: WO2020/128074
PCT Pub. Date: Jun. 25, 2020

(65) Prior Publication Data

US 2022/0039465 A1 Feb. 10, 2022

(30) Foreign Application Priority Data

Dec. 21, 2018 (EP) ..... 18215228

(51) Int. Cl.
*A24F 40/30* (2020.01)
*A24F 7/00* (2006.01)
(Continued)

(52) U.S. Cl.
CPC ..... *A24F 40/30* (2020.01); *A24F 7/00* (2013.01); *A24F 40/10* (2020.01); *A24F 40/20* (2020.01); *A24F 40/42* (2020.01)

(58) Field of Classification Search
CPC ..... A24F 40/30; A24F 40/10; A24F 40/20; A24F 40/42; A24F 7/00
(Continued)

(56) References Cited

U.S. PATENT DOCUMENTS 8,757,169 B2 * 6/2014 Gysland ..... A24F 40/00 131/270
9,661,878 B2 * 5/2017 Liu ..... A24F 40/60
(Continued)

FOREIGN PATENT DOCUMENTS

CN 207252789 U 4/2018
CN 207733663 U 8/2018
(Continued)

OTHER PUBLICATIONS

International Search Report for Application No. PCT/EP2019/086848 mailed Mar. 20, 2020, pp. 1-5.

*Primary Examiner* — Harshad C Patel
(74) *Attorney, Agent, or Firm* — Lerner David LLP

(57) ABSTRACT

An electronic cigarette includes a main body portion and a mouthpiece portion, the mouthpiece portion being moveably connected to the main body portion by a connection mechanism. The main body portion includes a first cartridge seating configured to receive a first cartridge and the mouthpiece portion includes a second cartridge seating configured to receive a second cartridge. The connection mechanism is configured to enable the mouthpiece portion to move relative to the main body portion between: a closed position in which the first cartridge seating is enclosed in the electronic cigarette; and an open position in which the first cartridge seating is exposed such that a first cartridge can be received, while the main body and the mouthpiece portion remain connected to each other by the connection mechanism.

15 Claims, 13 Drawing Sheets

(51) Int. Cl.
*A24F 40/10* (2020.01)
*A24F 40/20* (2020.01)
*A24F 40/42* (2020.01)

(58) Field of Classification Search
USPC ..... 131/329
See application file for complete search history.

(56) References Cited

U.S. PATENT DOCUMENTS

| | | | | |
|---|---|---|---|---|
| 9,888,727 | B2 * | 2/2018 | Li | H05B 1/0244 |
| 10,015,994 | B2 * | 7/2018 | Daryani | A24F 40/30 |
| 10,367,285 | B2 * | 7/2019 | Wang | H01R 12/774 |
| 10,869,508 | B2 * | 12/2020 | Huang | A24F 40/44 |
| 11,641,695 | B2 * | 5/2023 | Batista | A24F 40/485 392/403 |
| 11,684,082 | B2 * | 6/2023 | Zinovik | A24D 1/042 131/182 |
| 11,800,900 | B2 * | 10/2023 | Hawes | A24F 40/40 |
| 11,838,997 | B2 * | 12/2023 | Rosser | A61M 15/0043 |
| 2011/0226266 | A1 * | 9/2011 | Tao | A24F 3/00 131/185 |
| 2015/0374039 | A1 * | 12/2015 | Zhu | H05B 3/03 131/329 |
| 2016/0150828 | A1 | 6/2016 | Goldstein et al. | |
| 2016/0360788 | A1 * | 12/2016 | Wang | A24F 40/40 |
| 2016/0368693 | A1 * | 12/2016 | DeWitt | B65D 83/0005 |
| 2017/0172215 | A1 * | 6/2017 | Li | H05B 3/42 |
| 2018/0303158 | A1 * | 10/2018 | Chen | B65D 50/04 |

FOREIGN PATENT DOCUMENTS

| | | | |
|---|---|---|---|
| WO | 2012142190 | A1 | 10/2012 |
| WO | 2017093357 | A1 | 6/2017 |
| WO | 2018050610 | A1 | 3/2018 |

* cited by examiner

ELECTRONIC CIGARETTE AND CARTRIDGE FOR AN ELECTRONIC CIGARETTE

CROSS-REFERENCE TO RELATED APPLICATIONS

The present application is a national phase entry under 35 U.S.C. § 371 of International Application No. PCT/EP2019/086848, filed Dec. 20, 2019, published in English, which claims priority to European Application No. 18215228.0 filed Dec. 21, 2018, the disclosures of which are incorporated herein by reference.

FIELD OF INVENTION

The present invention relates to personal vaporizing devices, such as electronic cigarettes. In particular, the invention relates to an electronic cigarette configured to receive disposable cartridges containing a vaporizable material.

BACKGROUND

Electronic cigarettes are an alternative to conventional cigarettes. Instead of generating a combustion smoke, they vaporize a liquid, which can be inhaled by a user. The liquid typically comprises an aerosol-forming substance, such as glycerin or propylene glycol that creates the vapor. Other common substances in the liquid are nicotine and various flavorings. There are several different types of electronic cigarettes, and in general they can be divided into liquid vaporizers, heated tobacco vaporizers or a combination (i.e. a hybrid device) thereof.

The electronic cigarette is typically a hand-held inhaler system, comprising a mouthpiece portion and a power supply portion. Electronic cigarettes configured to receive disposable cartridges containing a vaporizable material are further provided with a mouthpiece portion, a power supply portion and a cartridge seating for accommodating the cartridge and for heating the substrate.

When a cartridge is to be replaced, the electronic cigarette is typically dismantled by disconnecting the mouthpiece portion from the power supply portion in order to access and remove the used cartridge. It is an object of the present invention to improve an electronic cigarette such that it is more user-friendly to replace the cartridges.

SUMMARY

According to a first aspect of the invention there is provided an electronic cigarette comprising a main body portion and a mouthpiece portion, the mouthpiece portion being moveably connected to the main body portion by a connection mechanism; the main body portion comprising a first cartridge seating configured to receive a first cartridge and the mouthpiece portion comprising a second cartridge seating configured to receive a second cartridge; wherein the connection mechanism is configured to enable the mouthpiece portion to move relative to the main body portion between: a closed position in which the first cartridge seating is enclosed in the electronic cigarette; and an open position in which the first cartridge seating is exposed such that a first cartridge can be received, while the main body and the mouthpiece portion remain connected to each other by the connection mechanism. In this way, a first cartridge may be inserted and removed from the first cartridge seating in a straightforward and user-friendly manner without disconnecting the mouthpiece from the device, thereby preventing the risk of losing or breaking the mouthpiece component.

As used herein, the term "inhaler" or "electronic cigarette" may include an electronic cigarette configured to deliver an aerosol to a user, including an aerosol for smoking. An aerosol for smoking may refer to an aerosol with particle sizes of 0.5-7 microns. The particle size may be less than 10 or 7 microns. The electronic cigarette may be portable.

The first cartridge may comprise an aerosol-forming substance such as propylene glycol and/or glycerol and may contain other substances such as nicotine and acids. The liquid L may also comprise flavorings such as tobacco, menthol or other flavors. The mouthpiece may comprise a vapor outlet through which a vapor generated in the first cartridge may be inhaled by a user when the mouthpiece is in the closed position.

The main body portion may comprise a first contacting surface and the mouthpiece portion may comprise a second contacting surface, wherein the first and second contact surfaces are brought together when the mouthpiece is brought to the closed position such that they are in contact or closely adjacent. The first and second contacting surfaces may be aligned in the closed position so as to be held against or near each other with a portion of one or both surfaces exposed in the open position. The first cartridge seating may be provided in the first contacting surface wherein movement of the mouthpiece portion to the open position exposes at least a portion of the first cartridge seating such that a first cartridge may be received. One or both contact surfaces may be substantially normal to an elongate axis of the main body portion or one or both may be angled to the elongate axis.

Since the mouthpiece portion comprises a second cartridge seating configured to receive a second cartridge, the characteristics of the generated vapor may be formed as a combination of two vapors generated from the respective cartridges such that vapor characteristics can be adjusted and enhanced, thereby improving the user experience.

Preferably the second cartridge is replaceable. The second cartridge may be inserted into the second cartridge seating through an opening in the second cartridge seating. The second cartridge seating may be provided by a mouthpiece channel which runs through the mouthpiece from a vapor outlet, through which vapor is inhaled, to an internal opening in the second contacting surface which is adjacent to the first cartridge seating when the mouthpiece is in the closed position, to a vapor outlet. The opening in the cartridge seating may be provided by the vapor outlet in the mouthpiece portion such that the second cartridge may be inserted when the mouthpiece is in a closed position. The second cartridge may be configured such that it provides a mouthpiece through which a user inhales the generated vapor. In particular, when the second cartridge is inserted a portion may protrude from the mouthpiece portion providing a mouthpiece.

The second cartridge may also comprise an aerosol-forming substance such as tobacco, propylene glycol and/or glycerol and may contain other substances such as nicotine and acids. The liquid may also comprise flavorings such as tobacco, menthol or other flavors.

Preferably the electronic cigarette is arranged such that, when the mouthpiece portion is brought to the closed position, a vapor flow path is created between the first cartridge and the second cartridge. In particular, when a first cartridge is received in the first cartridge seating, a second cartridge is received in the second cartridge seating and the mouthpiece is brought to the closed position a fluidic connection is formed between the first cartridge, the second cartridge and the mouthpiece. In this way, a vapor generated in the first cartridge, flows through the second cartridge which imparts new characteristics on the generated vapor before it is inhaled by the user through the mouthpiece. A wide range of different vapor characteristics may therefore be provided, enhancing the user experience and the inhaled vapor may have improved flavor or active ingredient content.

The first cartridge seating and second cartridge seating may be arranged such that in the closed position they are aligned to form the vapor flow path between the respective received cartridges to the mouthpiece. In particular, the main body portion may comprise a first contacting surface on which an opening to the first cartridge seating is provided and the mouthpiece portion may comprise a second contacting surface on which the second cartridge seating is provided wherein movement of the mouthpiece portion to the closed position aligns the openings to provide the vapor flow path between the cartridges to the mouthpiece. One of the openings may in a protruding portion of a contact surface and the other opening may be within a recessed portion of the opposing contact surface such that the protruding portion engages with the recessed portion to form a substantially sealed vapor flow path upon moving the mouthpiece to the closed position.

Preferably the main body portion further comprises a power supply and electrical circuitry; wherein the first cartridge comprises an atomizer and a liquid store; and the electrical circuitry is configured to connect the atomizer to the power supply when the first cartridge is received in the first cartridge seating. In this way the heating components are formed as part of the replaceable first cartridge so that they are regularly replaced to maintain effective functioning and generation of high quality vapor.

Preferably the second cartridge comprises a tobacco substrate. In this way, the vapor generated in the first cartridge passes through the tobacco substrate, picking up compounds which provide the generated vapor with an improved flavor and nicotine content, enhancing the user experience.

Preferably the electronic cigarette further comprises a first retaining element configured to releasably retain the mouthpiece portion in the closed position. In this way the mouthpiece is held securely in the closed position, prevent accidental opening which could result in loss of a cartridge, while also allowing a user to easily overcome the retaining force to open the device when needed.

Preferably the electronic cigarette further comprises a second retaining element configured to releasably retain the mouthpiece portion in the open position such that the mouthpiece portion is bistable and in an equilibrium position in both the open position and the closed position. The mouthpiece is thus held stably in both the open and closed positions, increasing the ease with which one or both cartridges can be replaced. The releasable retaining mechanism may further provide feedback to the user when moving the mouthpiece that it is secured in either the open or closed positions. Preferably the mouthpiece is always under the action of one or both magnetic retaining elements as it moves between the open and closed positions ensuring it will be brought to one of the two stable equilibrium positions from any point in its range of movement.

Preferably wherein the first and/or second retaining element comprises a magnet. Preferably the magnets are configured to provide an appropriate retaining force to both hold the mouthpiece securely in the required position while allowing the user to overcome it with a reasonable force to move the mouthpiece. The term "magnet" may comprise one or more of a permanent magnet, magnets of different polarities or ferromagnetic material.

Preferably the electronic cigarette further includes a biasing element configured to bias the mouthpiece into a closed position. The biasing element may be a spring such as a torsion spring or compression spring. The biasing element can be used in combination with one or both retaining elements and configured such that it brings the mouthpiece portion to the stable closed position from any point in its range of movement, other than when the mouthpiece portion is placed in the fully open stable position.

Preferably the connection mechanism provides a slideable connection between the mouthpiece portion and the main body portion such that the mouthpiece portion slides in a linear motion between the open position and the closed position. In particular, the slideable connection may be a mechanical slide mechanism such as a rail and follower arranged on the opposing first and second contact surfaces of the mouthpiece and main body portions to provide the relative movement between the open and closed positions. In this way, the mouthpiece portion may move linearly to expose an opening to the first cartridge seating.

Preferably the connection mechanism provides rotational connection between the mouthpiece portion and the main body portion such that the mouthpiece portion rotates relative to the main body portion between the open position and the closed position. In some examples, the main body portion is elongate and the axis of rotation of the mouthpiece portion is substantially parallel with the elongate axis of the main body. Equally the mouthpiece portion might rotate in a plane which is at an angle to the plane normal to the elongate axis. For example, where the first and second contact surfaces are angled, the mouthpiece portion may rotate in a plane parallel with the first and/or second contact surface. In this way the mouthpiece portion may rotate to expose a portion of the first contact surface of the mouthpiece in which the opening to the first cartridge seating is positioned.

Preferably the connection mechanism is a hinge mechanism such that the mouthpiece portion pivots about the hinge mechanism between the open position and the closed position. In particular the hinge mechanism may be configure to provide a pivoting, upward rotation of the mouthpiece portion away from the main body such that first and second contact surfaces separate in the manner of opening jaws to expose the first cartridge seating.

Preferably the electronic cigarette comprises a power supply and the main body is elongate; wherein the first cartridge seating and the power unit extend side by side in the elongate direction and the hinge mechanism is located above the battery. This makes efficient use of the internal space of the main body such that the electronic cigarette may be kept to a user friendly size.

The main body portion may comprise a rim which extends around the perimeter of a contact surface of the main body portion, the contact surface arranged to meet the mouthpiece portion in the closed position; wherein the hinge mechanism is positioned on the rim, external to the main body portion, such that the mouthpiece portion pivots about the rim between the open and closed position Preferably, the hinge mechanism comprises an internal lever, the lever being fixedly connected at one end to the mouthpiece portion and rotatably connected at the opposite end in a receiving portion located in the main body portion.

By providing an internal hinge mechanism, the mechanism is protected within the main body portion improving the lifetime of the mechanism and the external shape of the device may be uniform, improving the usability.

Preferably the lever is L-shaped and the lever connects a central point in the mouthpiece portion to a point near an edge of the main body portion. This allows an internal lever to provide an increased displacement of the mouthpiece portion with a smaller movement of the lever. In particular, the lever may be connected near a radial extremity of the first contact surface and nearer the center of the second contacting surface.

Preferably the receiving portion comprises an elongate slot which is configured to retain the rotating end of the lever while enabling it to both rotate in the elongate slot and move linearly along the elongate slot. In this way the displacement of the mouthpiece portion from the main body may be increased in the open position as the mouthpiece portion both rotates away from the main body and translates away from the main body. This allows an opening of the first cartridge seating to be exposed with a reduced degree of rotation of the mouthpiece portion, thereby reducing the space required for the hinge mechanism The main body portion may be elongate and the elongate slot may be at least approximately aligned with the elongate axis of the main body portion such that when the mouthpiece portion moves to the open position the mouthpiece portion both rotates relative to the main body portion and moves linearly away from the main body portion. The mouthpiece portion therefore moves away from the main body in a direction aligned with the elongate axis of the electronic cigarette, ensuring the first contacting surface is sufficiently exposed for the cartridge to be replaced. The linear movement of the mouthpiece portion 6 enables the opening of the main body cartridge seating to be liberated with a minimal degree of rotation of the mouthpiece portion 6 such that a first cartridge can be introduced The end points of the linear slot may define the positions of the rotating end of the lever when in the mouthpiece portion is in the open and closed positions.

Preferably the main body comprises a first magnetic retaining element which cooperates with a second magnetic retaining element on the lever, the first and second magnetic elements positioned to encourage both the rotational and linear movement of the mouthpiece portion to the open position. In particular the corresponding magnetic elements may be position such that the force of attraction is in a direction which causes rotation of the mouthpiece portion and linear movement of the mouthpiece portion.

Preferably, the mouthpiece portion comprises a seal configured to abut against a vapor outlet of the first cartridge when the mouthpiece is in the closed position to form a fluidic connection between the first cartridge and the mouthpiece. In some examples, the seal has a first side configured to abut against the first cartridge and an opposing second side configured to abut against the second cartridge when the mouthpiece is in the closed position to form a fluidic connection between the first cartridge and the second cartridge. In this way, a sealed vapor flow path is formed between the first cartridge and the mouthpiece to ensure vapor is transported efficient from the first cartridge, irrespective of the pressure in the surrounding enclosed volume.

Preferably the seal lies away from the opening to the first cartridge seating when the mouthpiece is in the open position but is brought into contact with the opening when in the closed position. The seal may form part of the mouthpiece. In this way, the seal does not interfere with exchange of the first cartridge.

Preferably, when the mouthpiece portion is in a closed position, the mouthpiece portion contacts the second cartridge such that an electric circuit is closed. In this way the heater may only be activated when the mouthpiece is in the closed position such that the circuit connecting the power source and heater is complete.

Preferably, the main body comprises an inner body and an outer housing and wherein the inner body is connected to the mouthpiece portion.

In a further aspect of the invention there is provided a kit comprising: the electronic cigarette according to any preceding claim; a first cartridge arranged to be received by the first cartridge seating; a second cartridge arranged to be received by the second cartridge seating.

In a further aspect of the invention there is provided a first cartridge configured for use with electronic cigarette as defined in any of the appended claims.

In a further aspect of the invention there is provided a method of using an electronic cigarette as defined in any of the appended claims, the method comprising opening the mouthpiece portion while the mouthpiece portion remains connected to the main body portion, inserting a first cartridge into the first cartridge seating; moving the mouthpiece to the closed position; activating a heater to generate an inhalable vapor. The method may further comprise inserting a second cartridge into a second cartridge seating; generating a vapor in the first cartridge such that it passes through the second cartridge to a vapor outlet for inhalation.

BRIEF DESCRIPTION OF THE DRAWINGS

The invention will now be described with reference to the appended drawings, which by way of example illustrate embodiments of the present invention and in which like features are denoted with the same reference numerals, and wherein.

DETAILED DESCRIPTION

Figure 1A:
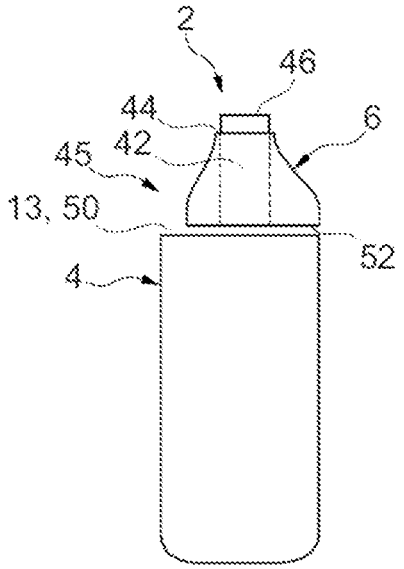
FIG. 1*a* is a schematic view of an electronic cigarette according to an exemplary embodiment of the present invention.
Figure 2A:
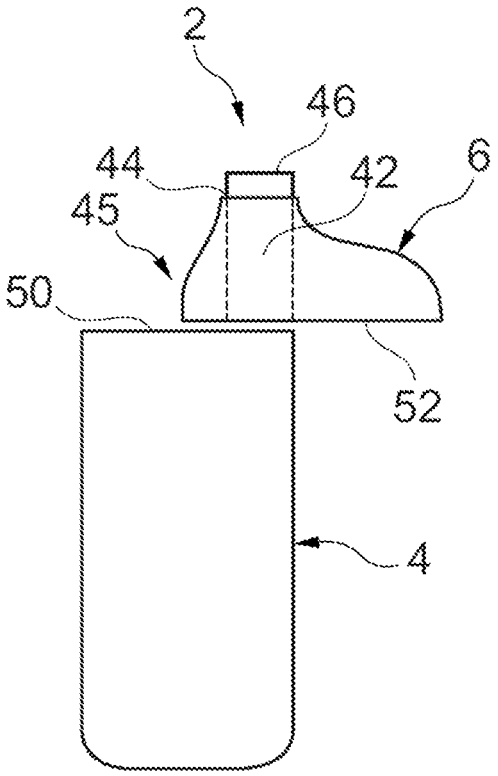
FIG. 2*a* is a schematic perspective view of an electronic cigarette according to another exemplary embodiment of the present invention.

Referring to FIGS. 1*a*, 2*a* and 3*a*, an electronic cigarette 2 according to embodiments of the present invention is illustrated. The electronic cigarette 2 has a main body portion 4 and a mouthpiece portion 6. The mouthpiece portion 6 is moveably connected to the main body portion 4 by a connection mechanism 45. The main body portion 4 comprises a first (main) cartridge seating 12 configured to receive a first removable cartridge 16 comprising a substance to be vaporized. The mouthpiece portion 6 is moveable relative to the main body portion 4 by the connection mechanism 45 between an open position in which the first cartridge seating 12 is exposed such that a first cartridge 16 can be received; and a closed position in which the first cartridge seating 12 is enclosed in the electronic cigarette 2. In this way, the mouthpiece portion 6 may be moved to the open position while remaining connected to the main body portion 4 via the connection mechanism 45 to allow a cartridge to be inserted into the first cartridge seating 12 of the main body portion 4. The mouthpiece portion 6 may then be returned to the closed position to enclose the received first cartridge 16 in the device 2. The user may then use the device by inhaling generated vapor through the mouthpiece portion 6. The mouthpiece portion 6 therefore provides a dual function of providing a lid to the cartridge seating 12 and its normal function of providing a vapor outlet for inhalation of the generated vapor. The mouthpiece portion 6 remains connected to the main body portion 4 at all times to enhance the ease of use and preventing loss of the mouthpiece.

Figure 3:
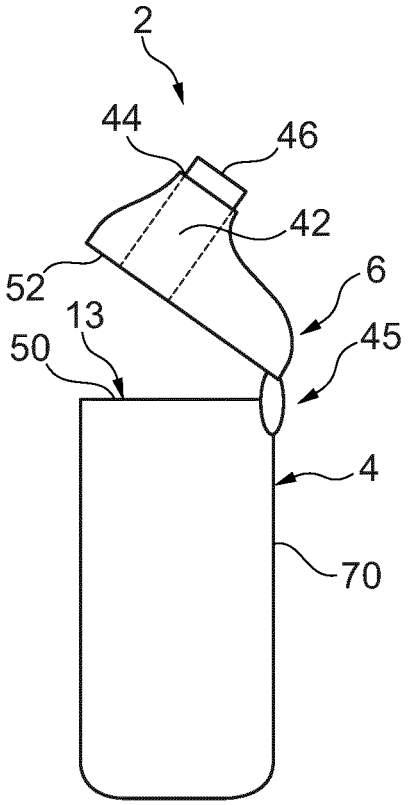
FIG. 3 is a schematic perspective view of an electronic cigarette according to a further exemplary embodiment of the present invention.

The main cartridge seating 12 is preferably in the form of a cavity configured to receive the first cartridge 16. In particular, the main body portion 4 comprises a first contact surface 50 and the mouthpiece portion 6 comprises a corresponding opposing second contact surface 52 which are brought together when the mouthpiece portion 6 is brought to the closed position, An opening 13 to the cavity of the first cartridge seating 12 is provided in the first surface 50 of the main body portion 4 such that when the mouthpiece portion 6 is brought to the open position, as shown in FIGS. 1*a*, 2*a* and 3, the opening 13 to the cavity of the first cartridge seating 12 is exposed allowing the first cartridge 16 to be inserted. Subsequent movement of the mouthpiece portion 6 to the closed position brings the second surface 52 of the mouthpiece portion 6 into engagement with the first surface 50 of the main body portion 4, enclosing the cartridge 16 received in the cavity of the first cartridge seating 12 within the device.

The mouthpiece portion 6 comprises a mouthpiece channel 42 leading to a mouthpiece vapor outlet 44 through which vapor generated in the device may be inhaled by the user. As most clearly shown in FIGS. 1*b* and 2*b*, when the mouthpiece portion 6 is in the open position the mouthpiece channel 42 is not aligned with the opening to the cavity of the first cartridge seating 12 of the main body portion 4. However when the mouthpiece portion 6 is moved via the connection mechanism 45 to bring the mouthpiece portion 6 into the closed position, the mouthpiece channel 42 is brought into alignment with the opening 13 of the cavity of the first cartridge seating 12. In this way, a vapor flow path is created from a first cartridge 16 (received in the cavity of the first cartridge seating 12) through the mouthpiece channel 42 to the vapor outlet 44.

Figure 4A:
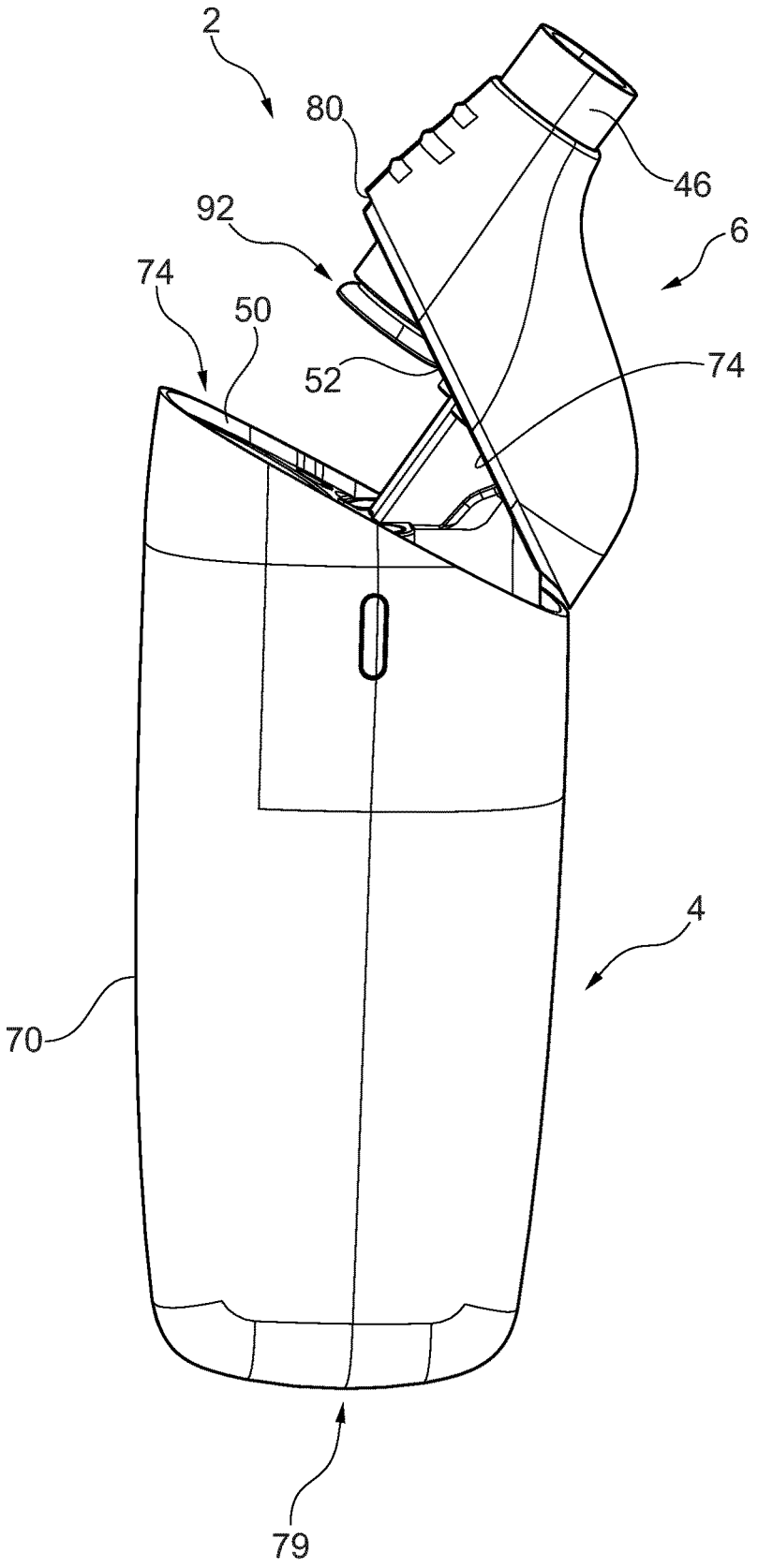
FIGS. 4*a* to 4*c* are schematic perspective views of an electronic cigarette according to another exemplary embodiment of the present invention.
Figure 5:
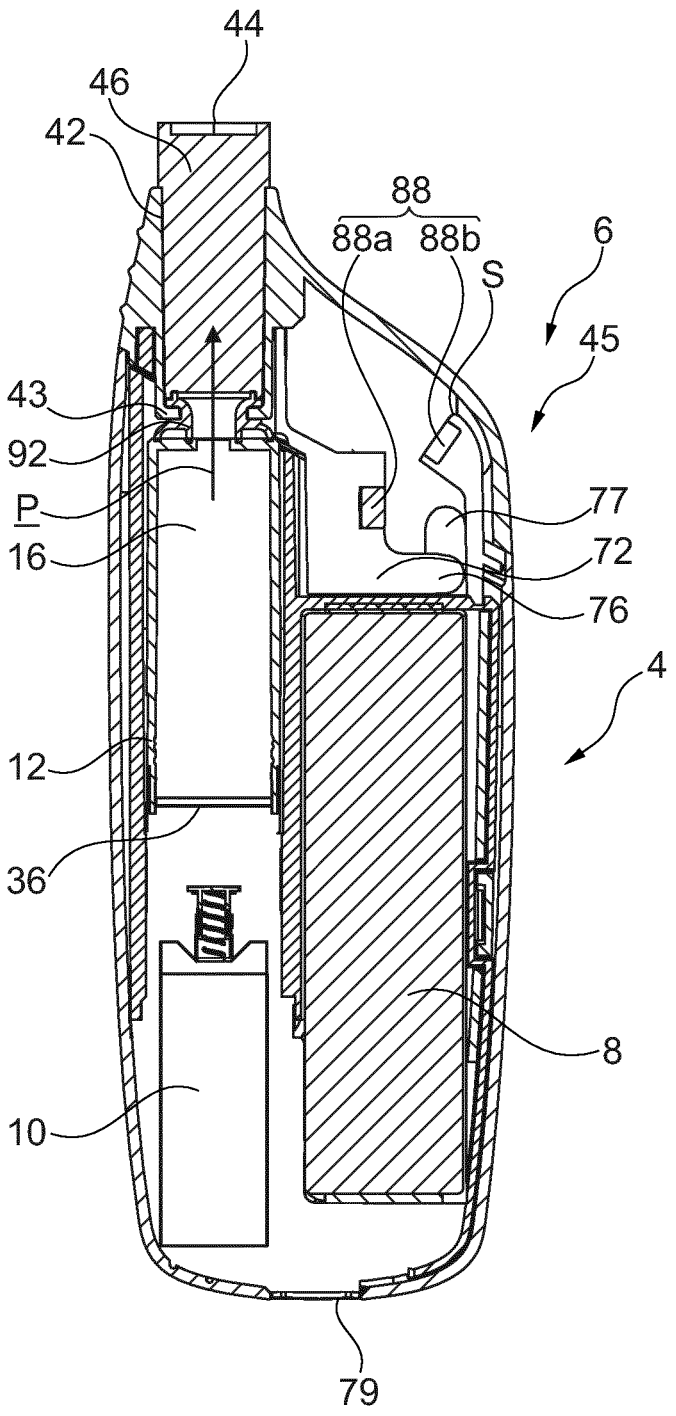
FIG. 5 is a schematic cross-sectional view of the electronic cigarette of FIGS. 4*a* to 4*b;*

As most clearly shown in FIG. 5, the main body of the portion 4 further comprises a power supply unit 8 and electrical circuitry 10 arranged to supply power to a heater to heat the vaporizable material in the first cartridge seating 12 to generate an inhalable vapor which passes through the mouthpiece channel 42 and vapor outlet 44 for inhalation by a user. The main body portion 4 (and the electronic cigarette device as a whole) may have a generally elongate shape between a first end 74 which engages with the mouthpiece portion 6 and a second end 79 at the base of the device 2, as illustrated in FIG. 4*a*. As shown in FIG. 5, the first cartridge seating 12 may be positioned adjacent to the power supply 8 such that they extend side by side in a direction corresponding to the elongate axis of the electronic cigarette 2. The connection mechanism 45 may be positioned above the power supply 8 which provides a compact arrangement.

In some examples of the invention the heater may be provided within the first cartridge 16, in particular the removable first cartridge 16 may include the atomizer components 30 arranged to heat the vapor forming substance held therein. As illustrated in FIG. 5, the device may be arranged such that when the first cartridge 16 is received in the chamber (the first cartridge seating 12), the power supply 8 within the main body portion 4 is connected to the atomizer 30 of the first cartridge via the electrical circuitry 10.

Figure 10:
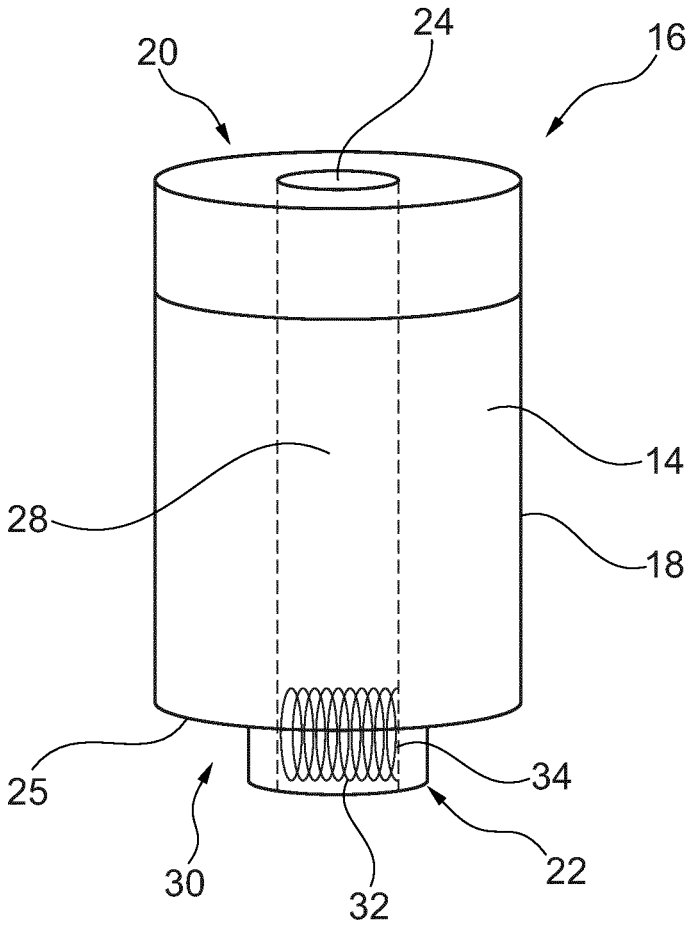
FIG. 10 is a schematic perspective view of an exemplary first cartridge.

A first cartridge 16 comprising an atomizer 30 configured for use with the first cartridge seating 12 is illustrated in FIG. 10. The first cartridge 16 comprises an atomizer 30 and a liquid store 14 containing a vaporizable liquid L. The liquid L may comprise an aerosol-forming substance such as propylene glycol and/or glycerol and may contain other substances such as nicotine and acids. The liquid L may also comprise flavorings such as e.g. tobacco, menthol or other flavors.

The first cartridge 16 is provided with a housing 18 having a first end 20 provided with a vapor outlet 24 and a second end 22 provided with a contact surface 25. A vapor channel 28 extends from the atomizer 30 at second end 22 of the first cartridge 16 to the vapor outlet 24 at the first end 20. In this way, vapor generated at the atomizer 30 at the second end 22 is transported through the cartridge vapor channel 30 to exit at the cartridge vapor outlet 24.

The atomizer 30 comprises a heater 32 and a fluid transfer element 34 configured to transfer liquid from the liquid store 14 to the proximity of the heater 32. For example the fluid transfer element 34 may be a porous or fibrous material configured to transfer the liquid L from the liquid store via capillary action and the heater 32 may be a heating coil, wrapped around the transfer element 34. The second end 22 of the cartridge 16 is configured as a connection portion 22, electrically connectable to electrical terminals 36 in the cartridge seating 12. For examples the connection portion 22 may comprise electrical contacts 36 (shown in FIG. 5) electrically connected to the heater 32 and arranged to connect with corresponding power terminals 36 on the cartridge 16, The electrical connectors 36 are advantageously placed at a bottom end of the main body cartridge seating 12, as shown in FIG. 5.

As illustrated in FIGS. 1 to 3, the mouthpiece portion 6 comprises a mouthpiece channel 42 and a mouthpiece vapor outlet 44. The mouthpiece channel 42 may be configured as a second cartridge seating 42 arranged to receive a second cartridge 46 having an internal vapor passageway through which vapor generated from the first cartridge 16 is drawn in use. In this way, the mouthpiece of the device 2, including the vapor outlet 44, is provided by the second cartridge 46 when it is received in the second cartridge seating 42. The second cartridge 42 may comprise a vapor-generating substance or a flavor enhancing substance. The second cartridge 46 can therefore release a substance, such as nicotine or a flavor and impart new characteristics on the vapor generated in the first cartridge 16. In a preferable embodiment, the second cartridge 46 comprises a tobacco granulate.

As described above, the main body portion 4 comprises a first contact surface 50 and the mouthpiece portion 6 comprises a second contact surface 52. When the mouthpiece portion 6 is in a closed position, the first contact surface 50 and the second contact surface 52 are aligned with each other such that a vapor flow path P is established from the atomizer 30 of the first cartridge 16, through the first cartridge vapor channel 30 and the second cartridge 46 received in the mouthpiece channel 42 to the mouthpiece vapor outlet 44. In this way, the characteristics of the vapor generated by the atomizer 30 of the first cartridge 16 may be altered or supplemented by being drawn through the vapor-generating substance or a flavor enhancing substance of the second cartridge 46 before reaching the vapor outlet 46.

As described in further detail below for each of the embodiments of FIGS. 1*a*, 1*b* and 1*c* a seal 92 may be provided to facilitate the effective fluid communication of vapor between the received first cartridge 16 and second cartridge 46. In particular a resilient deformable seal 92 may be provided on the underside of the mouthpiece portion 6 near the base of the second cartridge seating 42 such that insertion of the second cartridge 42 into the mouthpiece channel 42 from the vapor outlet 44 side brings the vapor inlet at the lower side of the second cartridge 46 into contact with a first, upper side of the seal 92. Similarly as the mouthpiece portion 6 is brought to a closed position a second, lower side of the seal 92 (opposing the first side of the seal 92) is brought into contact with the vapor outlet 28 of the first cartridge 16, deforming against it to provide a sealed vapor flow path between the two cartridges when the mouthpiece portion 6 is in the closed position.

The second cartridge 46 may be introduced into the second cartridge seating 42 such that when the mouthpiece portion 6 is in the closed position, the first 16 and second cartridges 46 are brought into fluidic communication and a combined vapor may be inhaled by the user through the mouthpiece. The second cartridge 46 may be introduced into an opening in the second cartridge seating. The opening may be provide by a vapor outlet 44 in the mouthpiece portion 6 such that the second cartridge 46 may be inserted when the mouthpiece portion 6 is in the closed position.

As described above, the mouthpiece portion 6 remains connected to the main body 4 in both the open position and the closed position. This has an advantage that the electronic cigarette 2 can for instance be opened with one hand whilst holding the first cartridge 16 in the other hand, Additionally, there is less risk of accidentally dropping the electronic cigarette 2 or parts thereof as there is only one uniform part to hold on to during cartridge replacement.

Figure 1B:
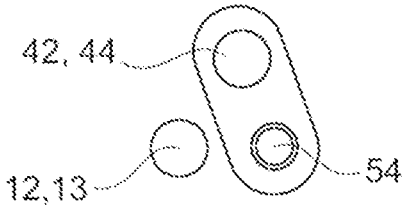
FIG. 1*b* is a top view of the electronic cigarette of FIG. 1*a;*
Figure 1C:
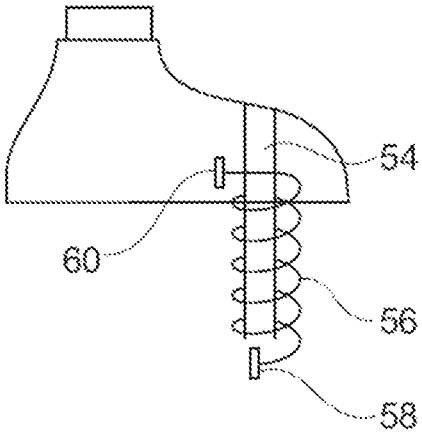
FIG. 1*c* is a schematic view of the connection of the mouthpiece portion and main body portion of the electronic cigarette in FIGS. 1*a* and 1 *b;*

As illustrated in FIGS. 1*a* to 1*c*, the connecting mechanism 45 between the mouthpiece portion 6 and the main body portion 4 can be configured in a number of different ways to provide the movement of the mouthpiece portion 6 between the open and closed position.

In FIG. 1*a* the connection mechanism 45 provides a rotational movement of the mouthpiece portion 6 relative to the main body portion 4. In particular the mouthpiece portion 6 may rotate about an axis of rotation which is approximately parallel with the elongate axis of the device. Alternatively the mouthpiece portion 6 may rotate in a plane which substantially corresponds to that defined by the first 50 and second 52 contacting surfaces which meet in the closed position. As shown in FIG. 1*b* the mouthpiece portion 6 rotates about a pin or a rod 54 interconnecting the mouthpiece portion 6 with the main body portion 4. In particular the pin or rod 54 may be positioned at one side of the mouthpiece portion 6 such that the opposing side, comprising the mouthpiece channel 42 rotates out and away from the main body portion 4 to expose the opening 13 of the first cartridge seating 12 in the first contacting surface 50.

It is advantageous to retain the mouthpiece portion 6 in a closed position in order to achieve a stable operation and to avoid that the first cartridge 16 accidentally falling out if the mouthpiece portion 6 is unintentionally left in an open position. The mouthpiece portion 6 may therefore be biased into a closed position. A biasing element 56 such as a torsion spring 56 can be arranged around the pivot pin 54, and biased between a first abutment surface 58 on the main body 6 and a second abutment surface 60 on the mouthpiece portion 6, as illustrated in FIG. 1*c*.

Figure 2B:
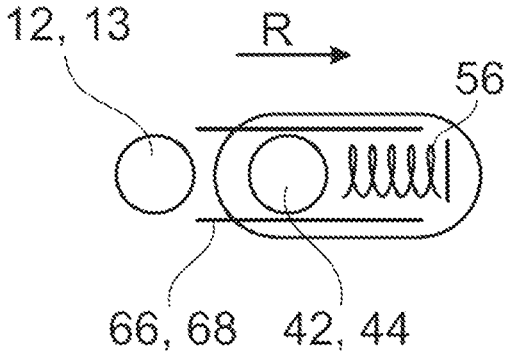
FIG. 2*b* is a top view of the electronic cigarette of FIG. 2*a;*

In another exemplary embodiment of the electronic cigarette 2 as illustrated in FIGS. 2*a* and 2*b*, the connection mechanism 45 a slider mechanism 45 arranged to provide a slideable connection between the main body portion 4 and the mouthpiece portion 6. The slider arrangement 45 enables the mouthpiece portion 6 to be linearly movable between an open position and a closed position in the radial direction R of the first contact surface 50 of the main body portion 4. That is, the mouthpiece portion 6 translates in a direction substantially perpendicular to the elongate axis of the device. In this way, the mouthpiece portion 6 moves by its contacting surface 52 sliding across the opposing contacting surface 50 of the main body to expose the opening 13 to the first cartridge seating 12.

Again, the mouthpiece portion 6 is preferably biased into the closed position. The biasing effect may be achieved by a compression spring 62, as shown in FIG. 2*b*. The connecting mechanism 45 may further comprise a guide connection 64 comprising a rail 66 and follower 68 arranged on the first contact surface 50 and the second contact surface 52. The guide connection enables the mouthpiece portion 6 to be connected to the main body portion 4 and guided when displaced in the radial direction R.

As illustrated in the embodiment of FIG. 3, the connecting mechanism 45 between the mouthpiece portion 6 and the main body portion 4 can alternatively be configured as a hinge mechanism 45. The hinge mechanism 45 is arranged to interconnect the main body portion 4 to the mouthpiece portion 6. As seen in FIG. 3, the hinge mechanism 45 can be arranged on an outer extremity of the outer housing 70 of the main body 4. That is the hinge 45 is provided at a radial extremity of the cross-section of the main body portion 4. In the example of FIG. 3, the hinge mechanism 45 is substantially external to the device 2, facilitating the pivoting motion of the mouthpiece portion 6 which exposes the opening 13 to the chamber providing the first cartridge seating 12 in the first contacting surface 50. The first contacting surface 50 may comprise a rim extending around the perimeter of the first contacting surface 50 and the hinge 45 may be provided on the rim such that the point of rotation is raised slightly from the first contacting surface to provide a clearance allowing the mouthpiece portion 6 to sufficiently rotate.

Alternatively, as seen in the embodiment illustrated in FIG. 5, the hinge mechanism 45 is located inside the electronic cigarette 2. This is advantageous as the hinge mechanism 45 is invisible from the outside of the electronic cigarette 2 such that a user's hand does not interfere with the hinge mechanism 45 when using the device. Furthermore the hinge mechanism 45 can be protected inside the electronic cigarette 2 when the electronic cigarette 2 is in a closed position.

Figure 4B:
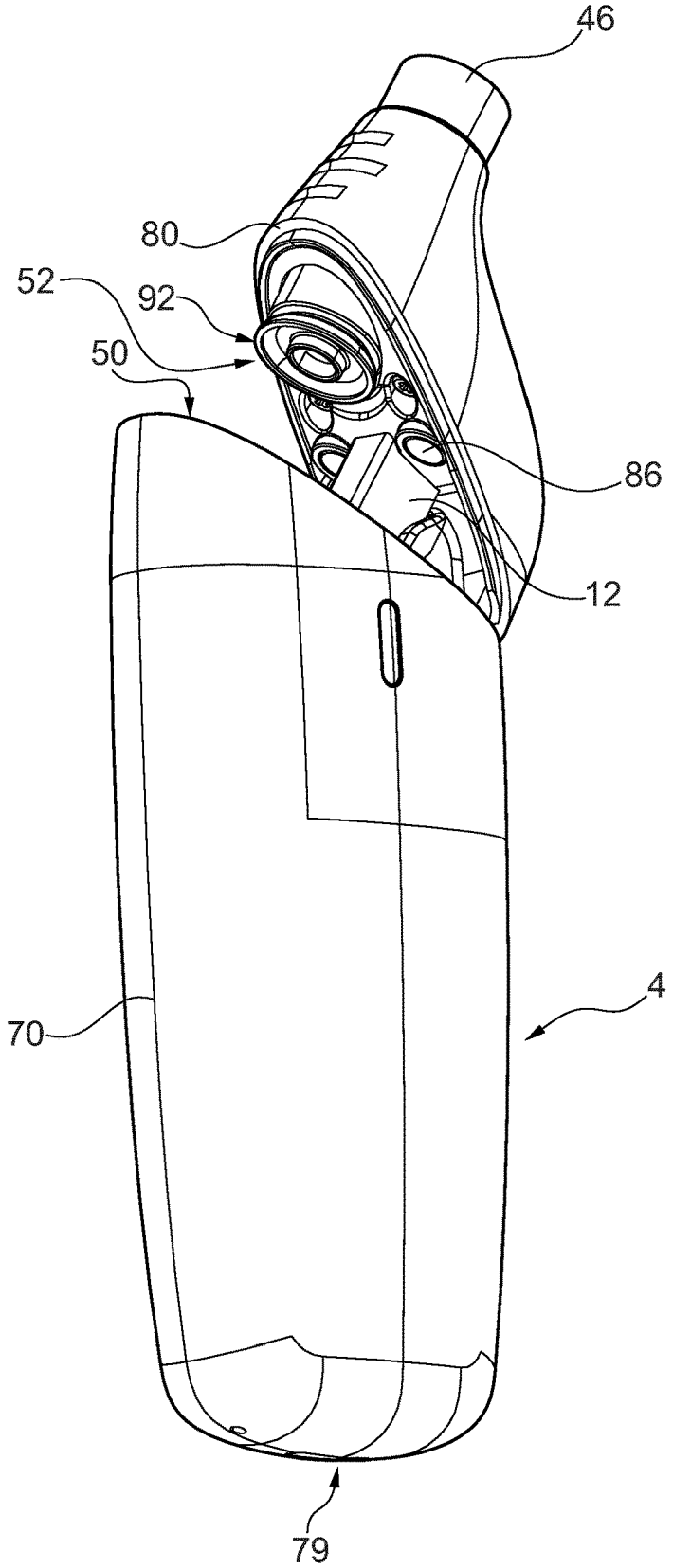
Figure 4C:
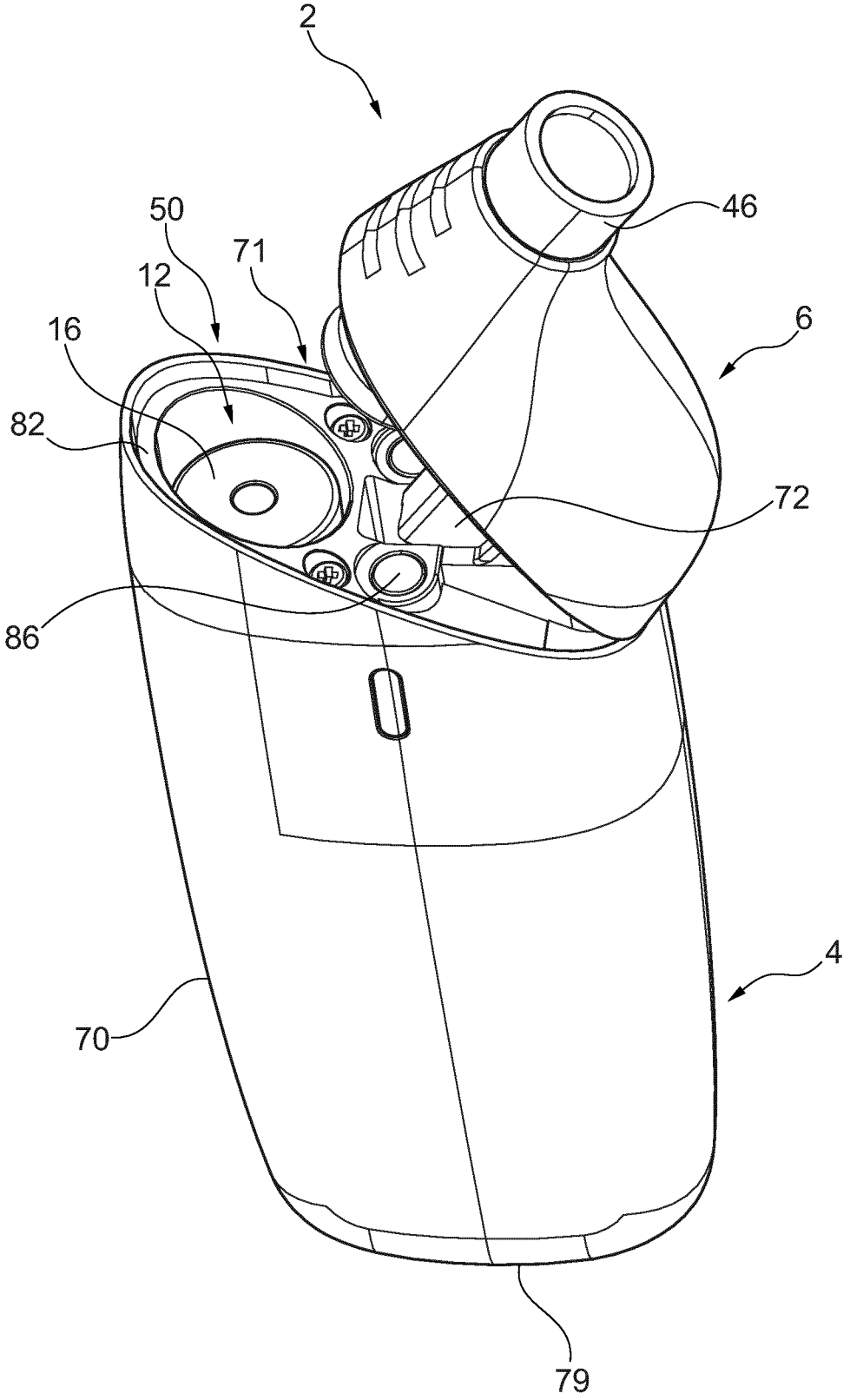

As shown in FIG. 4*c*, the main body portion 4 may comprise an outer housing 70 and an inner assembly 71. The outer housing 70 comprises an open end 74 and a closed end 79, as indicated in FIG. 4*a*. The inner assembly 71 may comprise a support (non-illustrated), onto which the electrical circuitry 10 and the power supply unit 8 are mounted. The hinge mechanism 45 may be arranged in the inner assembly 71 of the main body portion 4.

As best seen in FIGS. 4*b*, 5, 6 and 7, the hinge mechanism 45 comprises a lever 72 comprising a first connection end 74 fixedly connected to the mouthpiece portion 6 and a second connection end 76 rotatably connected to a receiving portion 77 of the main body portion 4. The second connection end 76 is configured such as to be rotatably connected to the inner assembly 72 of the main body portion 4. In an embodiment, the second connection end 76 can be configured as a rotating joint 76. The rotating joint 76 may be in the form of a pin or axle which is retained within the receiving portion of the main body 4 such that the rotating joint 76 defines the axis of rotation about which the lever 72 may rotate.

It is desirable to create an electronic cigarette device 2 with a compact and ergonomic shape. It is therefore needed to reduce the internal space needed for the hinge mechanism 45. The movement of the lever 72 in the horizontal direction of the electronic cigarette 2 should therefore be reduced. The hinge mechanism 45 may therefore be designed to provide a combined rotary and linear movement of the mouthpiece portion 6 as it is moved to the open position.

The hinge mechanism 45 can be configured to enable the mouthpiece portion 6 to both rotate and move axially away from the main body portion 4 which allows for the opening 13 of the first cartridge seating 12 to be exposed with a reduced degree of rotation of the mouthpiece portion 6, thereby reducing the space required for the hinge mechanism 45. To achieve the rotation and linear motion of the mouthpiece portion 6, the receiving portion 77 in the form of an elongate axial slot 77, shown in FIGS. 5 and 8*a*, in which the rotating joint 76 at the rotating end 76 of the lever 72 is retained. The linear slot 77 and the lever 72 are retained such that the rotating end of the lever 72 may rotate within the slot 77 and move linearly in a direction corresponding to the elongate axis of the slot 77. In this way the lever 72 can both rotate and translate as the mouthpiece portion 6 moves to the open position.

The linear slot 77 therefore defines end positions comprising the limits of the linear movement, where the end positions correspond to the position of the rotating joint 76 when the mouthpiece portion 6 is located in the closed position and the open position, respectively. Hence the joint 76 at the rotating end of the lever 72 is located in a lower end of the linear slot when the mouthpiece portion 6 is in a closed position, as shown in FIGS. 5 and 8*a*, and the joint 76 is located in an upper end of the linear slot 77 when the mouthpiece portion 6 is in an open position, as shown in FIG. 8*b*.

Figure 8A:
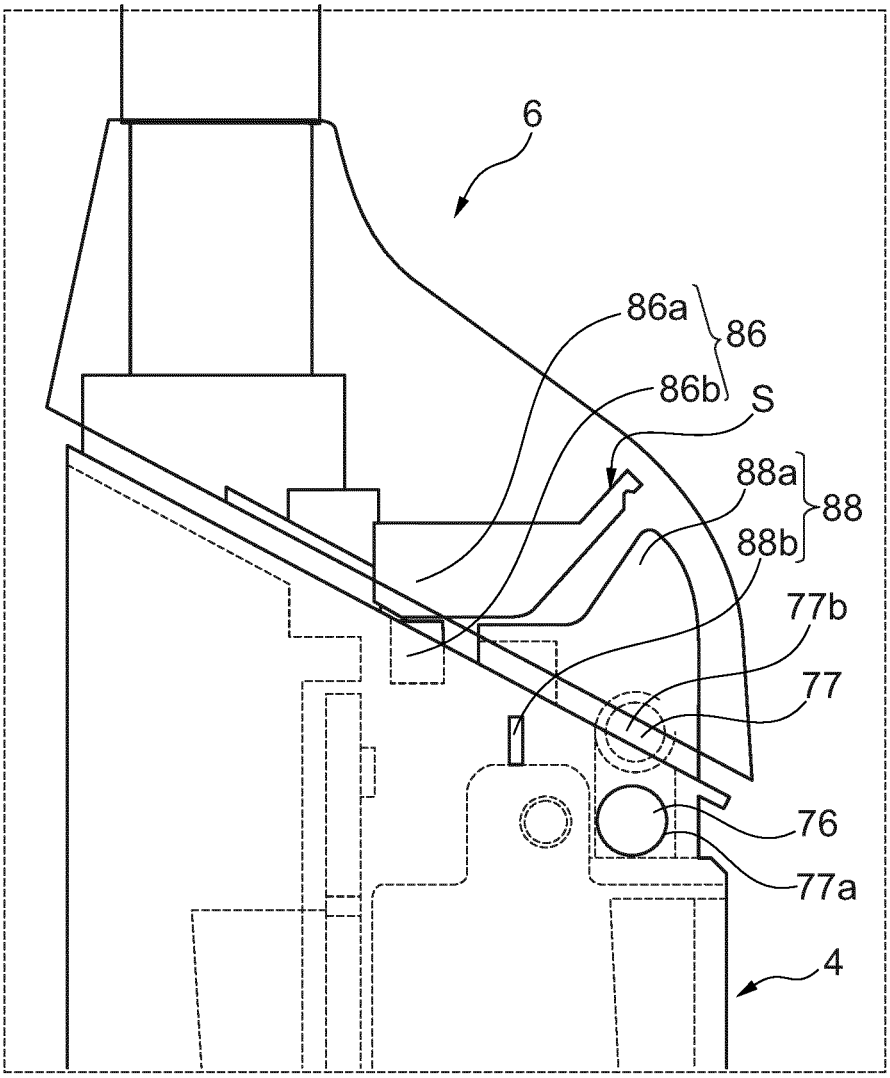
FIGS. 8*a* and 8*b* are partially transparent top views of the mouthpiece portion in a 25 closed and an open position, respectively.
Figure 8B:
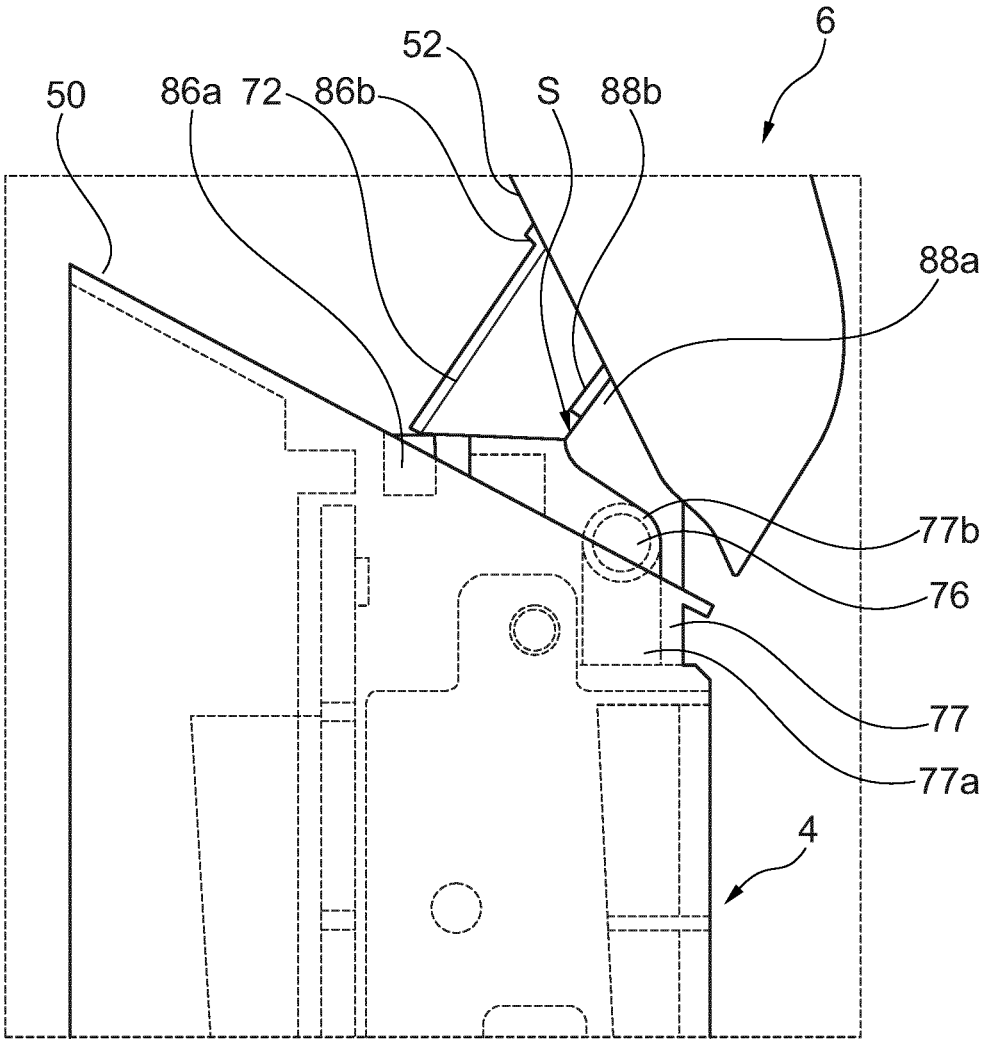
Figure 9A:
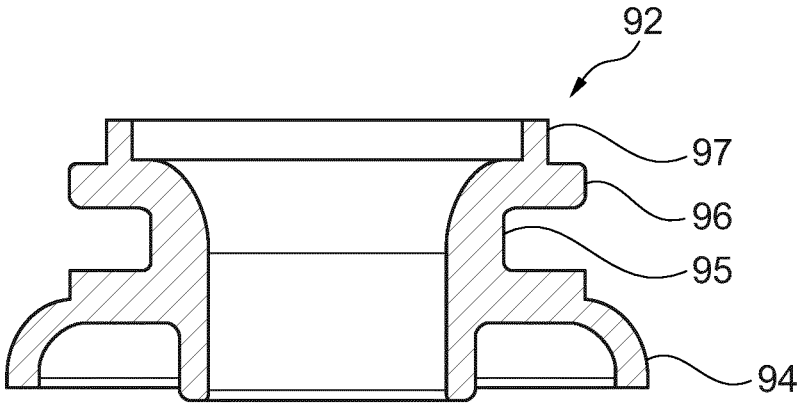
FIG. 9*a* is a schematic cross-sectional view of a cartridge seal according to an embodiment of the present invention.
Figure 9B:
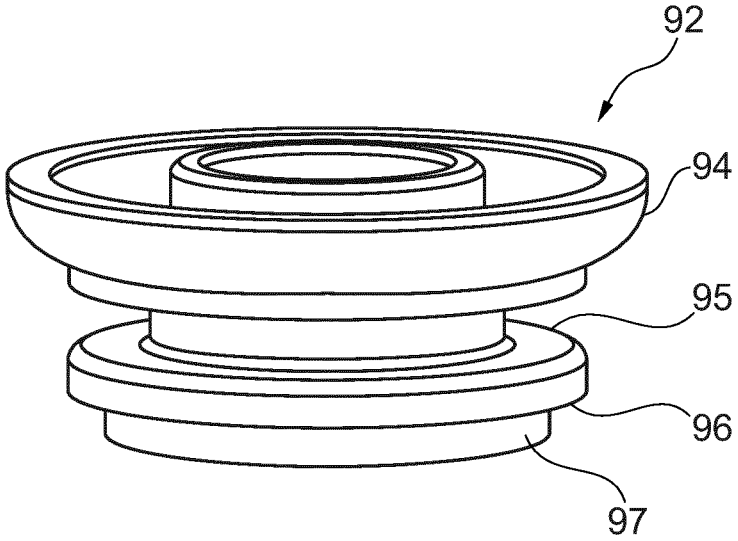
FIG. 9*b* is a schematic perspective view of the seal in FIG. 9*a*.

The limiting surface S, shown in FIGS. 5, 8*a* and 8*b*, can be provided on an axial extension connected to the inner assembly 71 and is met by a corresponding surface of the lever when it reaches the fully open position, thus limiting further rotation of the lever 72. In other words, the main body portion 4 comprises an internal surface S arranged to be met by the lever 72 as it rotates to prevent further rotation at a certain point. This surface S may be provided as a portion that extends from the first contacting surface 50 in a direction towards the mouthpiece along the elongate axis of the main body 4.

The linear movement of the mouthpiece portion 6 enables the opening 13 of the main body cartridge seating 12 to be liberated with a minimal degree of rotation of the mouthpiece portion 6 such that a first cartridge 16 can be introduced. This also reduces the space required in the inner assembly 72 for the hinge mechanism 45. Hence, the linear movement enables the mouthpiece portion 6 to be further displaced away from the main body portion 4 by an upwards movement.

One or more retaining elements 88, preferable in the form of magnetic element may be positioned such as to encourage the rotational and linear movement of the mouthpiece portion 6 provided by the hinge mechanism 45. In particular a magnetic element 88*b* (see FIG. 5) may be provided on the limiting surface S and corresponding magnetic material 88*a* on the opposing surface of the lever 72 such that upon the user initially opening the mouthpiece portion 6 the lever 72 is encouraged to rotate and translate upwards linearly such that the corresponding magnets meet, then retaining the mouthpiece portion 6 in a stable, open position.

Figure 6:
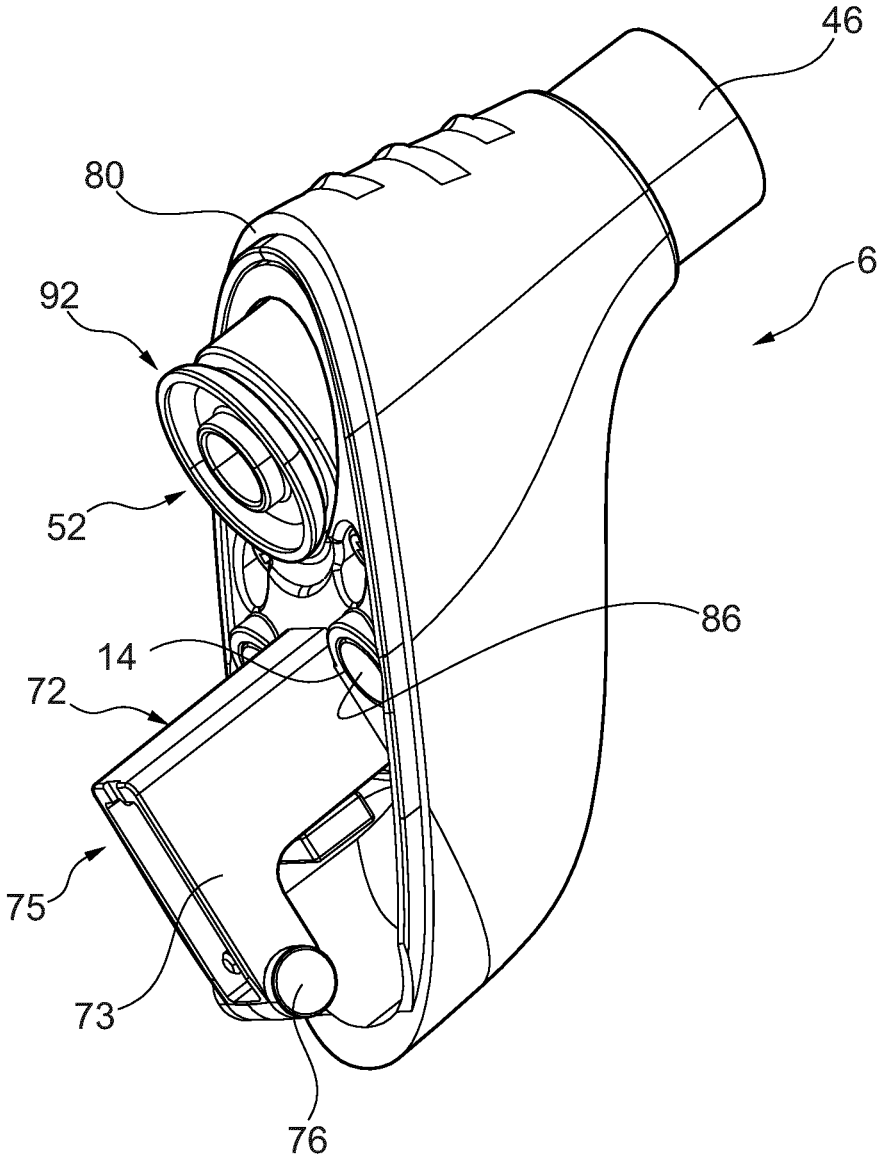
FIG. 6 is a schematic perspective view of the mouthpiece portion of the electronic cigarette of FIGS. 4*a* to 4*b* and 5.
Figure 7:
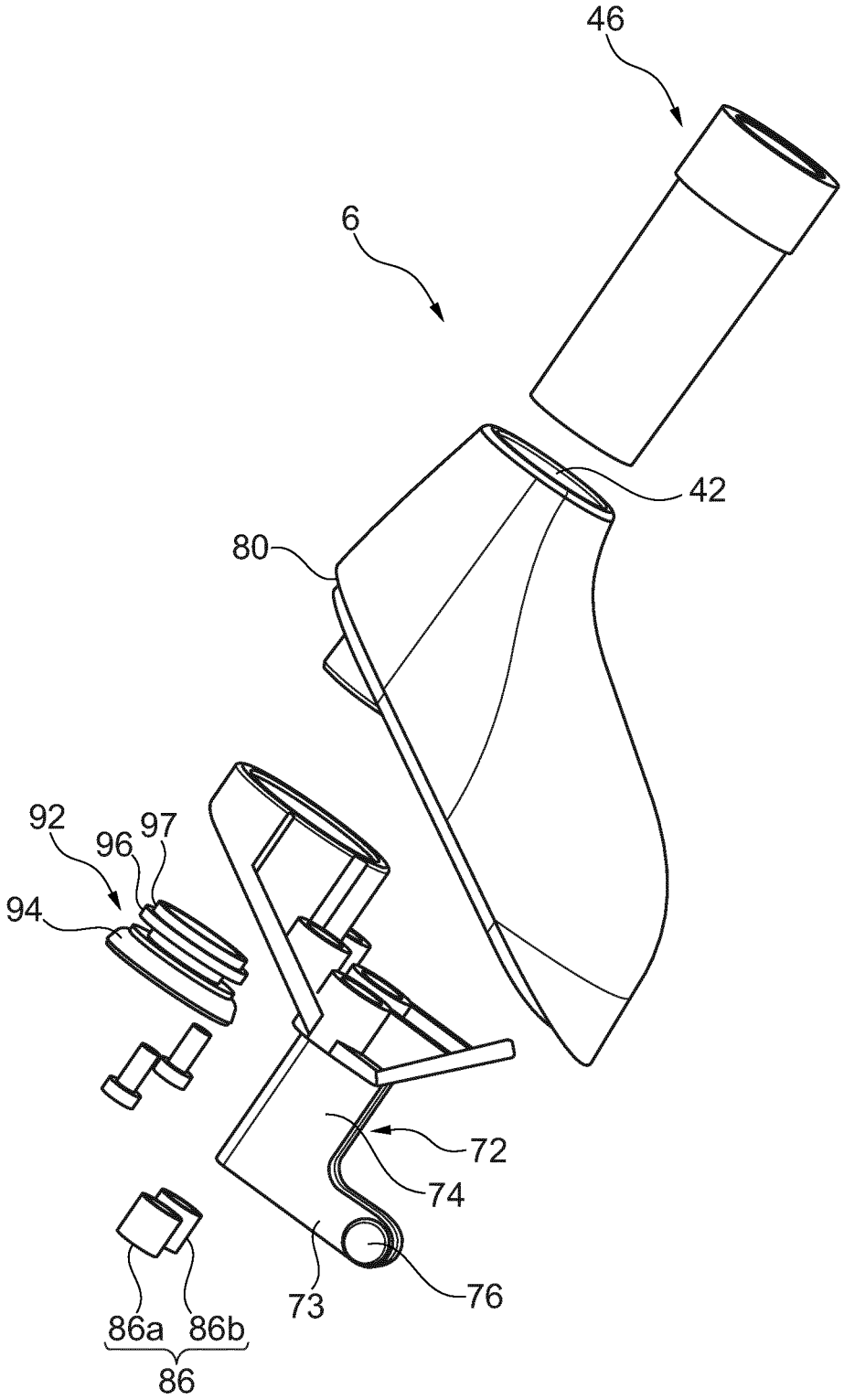
FIG. 7 is an exploded view of the mouthpiece portion of the electronic cigarette of FIG. 6.

The lever 72 is substantially L-shaped and comprises a horizontal portion 73, a vertical portion 75 and the joint 76, as shown in FIG. 6. The L shape allows a point towards the center of the contacting surface 52 of the mouthpiece portion 6 to be connected to a point near the radial extremity of the contacting surface 50 of the main body portion 4. This allows for an internal lever mechanism to be provided and enhances the displacement of the mouthpiece portion 6 from the main body portion 4 for a smaller degree of rotation.

The first contact surface 50 of the main body 6 and the second contact surface 52 of the mouthpiece are further configured to create a closed connection between the main body portion 4 and the mouthpiece portion 6 when the electronic cigarette 2 is in a closed position (i.e. when in an operating state). As best seen in FIGS. 4*a* and 4*b*, the second contact surface 52 of the mouthpiece portion 6 comprises a first rim 80 which extends around the perimeter of the second contacting surface 52. The first contact surface 50 of the main body portion 4 comprises a second rim 82, arranged to engage with the first rim 80 of the mouthpiece portion 6 to enclose the connection between the first and second cartridges.

At least a portion of the second contact surface 52 of the mouthpiece may be protruding in relation to the first rim 80, i.e. it extends towards the opposing surface of the main body beyond the enclosing rim 80 of the mouthpiece 6. The first contact surface 50 located on the inner assembly 71 of main body 4 may preferably comprise at least a portion which is recessed in relation to the rim 82 of the outer housing of the main body 4. This arrangement is illustrated in FIGS. 4*a* and 4*b*. This enables the first contact surface 50 to extend into the main body portion 4, whereby the formation of a gap is between the mouthpiece portion 6 and the main body portion 4 can be prevented to ensure effective fluidic communication between the first and second cartridges. In other words a portion of the second contacting surface 52 of the mouthpiece protrudes from the second contacting surface 52 and is received by a correspondingly shaped recessed portion of the first contacting surface of the main body. The protruding and recessed portions correspond to the position of the first 12 and second 42 cartridge seatings and thereby facilitate the fluidic communication of vapor. Additionally, this arrangement allows the contacting surfaces 50, 52 to be positioned closer to each other when the electronic cigarette 2 is in a closed position. When the mouthpiece portion 6 is in a closed position, the rim 80 of the mouthpiece portion 6 is configured to abut against the upper rim 82 of the main body portion 4.

The connection between the mouthpiece portion 6 and the main body portion 4 is configured to prevent a pressure loss. In that way, the electronic cigarette 2 maintains responsive and the flow through the vaporization chamber 31 is optimized. This means that most of the volume inhaled consists of vapor that comes from the vaporization chamber 31 rather than air from clearances in the connection between the mouthpiece portion 6 and the main body portion 4. This may be further enhanced by the use of a seal 92, as described in more detail below.

The hinge mechanism 45 may be configured to provide a stable connection between the first contacting surface 50 and the second contacting surface 52. That is, the hinge mechanism may be configured such that the closed position is an equilibrium position. This can be achieved by the provision of one or more magnetic retaining elements 86 arranged on the first contact surface 50 and corresponding magnetic retaining elements 86 positioned on the second contact surface 52. The magnetic retaining elements 86 are configured to hold the mouthpiece portion 6 in a closed position. The retaining element 86 can be a combination of a magnet and a ferromagnetic material such as steel. Alternatively, a set of magnets of different polarities can be used. As best seen in FIGS. 4*a* and 4*b*, the first set of retaining elements 86 are arranged on the first 50 and the second contacts surfaces 52, respectively. This enables a close connection between the magnets and the ferromagnetic material.

The first set of magnetic retaining elements 86 may be arranged such that the mouthpiece portion 6 can be in an open position without being influenced by the magnetic closing force from the magnet. However, as the mouthpiece portion 6 is being closed such that the first connection surface is moved closer to the second connection surface, the mouthpiece portion 6 enters into a range of influence from the magnet and is therefore moved and held into a closed position. This first set of magnets 86 which releasably retain the mouthpiece portion 6 in a closed position are illustrated in FIGS. 4*b* and 4*c*.

As described above, the electronic cigarette 2 may further comprise a second set of magnetic retaining elements 88 which are configured to releasably retain the mouthpiece portion 6 in an open position. The second set of retaining elements 88 may be identical to the first set of retaining element 86, but arranged in a different position that the first retaining elements 86. In particular, the second set of retaining magnets 88 can be provided at a position 88*a* on the inner limiting surface S of the main body 4 (on an axial extension of the inner assembly) and a corresponding position 88*b* on a surface the lever 72 which meets the limiting surface when in the open position. These positions 88*a* and 88*b* are shown in FIGS. 8*a* and 8*b*. The first and the second set of magnets 86, 88 create a bistable positioning of the mouthpiece portion 6 where equilibrium positions are provided at the fully closed and fully open positions. The first set of magnetic retaining elements 86 and the second set of magnetic retaining elements 88 are further configured such that the mouthpiece portion 6 is always under influence of a force from at least one of the sets of retaining elements. This assists the opening and closing function of the mouthpiece portion 6 as the user only needs to give the mouthpiece portion 6 a small "push" to enable the mouthpiece portion 6 to change from the open position to the closed position and vice versa.

The limiting surface S is a stationary surface which is fixedly connected to the main body portion 4. As seen in FIG. 5, the stationary surface S may be arranged to extend from the inner assembly 71. The stationary surface S is provided at an angle $\alpha$ in relation to the longitudinal (elongate) axial direction of the electronic cigarette 2 such that the mouthpiece portion 6 is rotated until the first cartridge seating 12 is exposed such that a first cartridge 16 can be introduced.

As best seen in FIGS. 4*a*, 4*b*, 9*a* and 9*b*, a resilient seal 92 can be arranged between the first end 20 of the first cartridge 16 and the mouthpiece channel 42. The resilient seal 92 can be attached to the vapor channel 42 of the mouthpiece portion 6. The seal 92 is configured to be deformed against the first cartridge 16 by the magnetic force Fm of the first retaining element 86. The resilient seal 92 has a deformation distance so that it can accommodate for variations in insertion depth of the first cartridge in the main cartridge seating 16.

The seal 92 is configured to create a tight connection when a negative pressure is created in the mouthpiece portion 6 by a user inhaling from the mouthpiece. The seal 92 has a first flange 94, a second flange 96 and a waist portion 95 located therebetween. The first flange 94 is configured to contact the first end 20 of the first cartridge 16 and the second flange 96 is configured to contact the opposing end of the second cartridge 46. In this way, the vapor flow path P is sealed from the vapor outlet of the first cartridge to the vapor outlet of the second cartridge 46, through which the user inhales the vapor.

The cartridge seating 42 (provided by the mouthpiece channel 42) can be further provided with a radial flange 43, shown in FIG. 5, which extends into the center of the mouthpiece channel 42. The radial flange 43 is configured to extend into the waist portion 95 of the seal in order to fixedly connect to the seal 92. When a first cartridge 16 and a second cartridge 46 are located inside the electronic cigarette 2 and the electronic cigarette 2 is in a closed position, the first flange 94 is depressed against the first cartridge 16 and a rim 97 the second flange 96 is depressed against the second cartridge 46.

Additionally, the electrical connectors 36 in the main body cartridge seating 12 can be configured to resiliently engage with the corresponding power terminals on the cartridge 16, In such a way, when the mouthpiece portion 6 is in a closed position, the closing force Fm created by the first set of retaining elements 86 is higher than the resilient force Fb from the electrical connectors 36 such that at least one power terminal 36 can be depressed and an electric circuit can be closed.

The seal is compressed in the axial direction from both the magnetic retaining elements 86 and the biasing force from the electric contacts. However, the magnetic force from the retaining elements 86 needs to be greater than the biasing force in order to avoid the first contact surface 50 of the mouthpiece portion 6 to disconnect from the second contact surface of the main body portion 4.

The skilled person will realize that the present invention by no means is limited to the described exemplary embodiments. The mere fact that certain measures are recited in mutually different dependent claims does not indicate that a combination of these measures cannot be used to advantage. Moreover, the expression "comprising" does not exclude other elements or steps. Other non-limiting expressions include that "a" or "an" does not exclude a plurality and that a single unit may fulfill the functions of several means. Any reference signs in the claims should not be construed as limiting the scope. Finally, while the invention has been illustrated in detail in the drawings and in the foregoing description, such illustration and description is considered illustrative or exemplary and not restrictive; the invention is not limited to the disclosed embodiments.

The invention claimed is:

1. An electronic cigarette comprising:

a main body portion and a mouthpiece portion, the mouthpiece portion being moveably connected to the main body portion by a connection mechanism;

the main body portion comprising a first cartridge seating configured to receive a first cartridge and the mouthpiece portion comprising a second cartridge seating configured to receive a second cartridge; wherein the connection mechanism is configured to enable the mouthpiece portion to move relative to the main body portion between:

a closed position in which the first cartridge seating is enclosed in the electronic cigarette; and an open position in which the first cartridge seating is exposed such that a first cartridge can be received therein, while the main body portion and the mouthpiece portion remain connected to each other by the connection mechanism.

2. The electronic cigarette according to claim 1, wherein the electronic cigarette is arranged such that, when the mouthpiece portion is brought to the closed position, a vapour flow path is created between the first cartridge and the second cartridge.

3. The electronic cigarette according to claim 1, wherein the main body portion further comprises a power supply and electrical circuitry; wherein the electrical circuitry is configured to connect an atomizer of the first cartridge to the power supply when the first cartridge is received in the first cartridge seating.

4. The electronic cigarette according to claim 1, further comprising a biasing element configured to bias the mouthpiece into the closed position.

5. The electronic cigarette according to claim 1, wherein the connection mechanism provides a slideable connection between the mouthpiece portion and the main body portion such that the mouthpiece portion slides in a linear motion between the open position and the closed position.

6. The electronic cigarette according to claim 1, wherein the connection mechanism provides rotational connection between the mouthpiece portion and the main body portion such that the mouthpiece portion rotates relative to the main body portion between the open position and the closed position.

7. The electronic cigarette according to claim 6, wherein the main body portion is elongate and an axis of rotation of the mouthpiece portion is substantially parallel with an elongate axis of the main body.

8. The electronic cigarette according to claim 1, wherein the connection mechanism is a hinge mechanism such that the mouthpiece portion pivots about the hinge mechanism between the open position and the closed position.

9. The electronic cigarette according to claim 8, wherein the hinge mechanism comprises an internal lever, fixedly connected at one end to the mouthpiece portion and rotatably connected at an opposite end in a receiving portion located in the main body portion.

10. The electronic cigarette according to claim 9, wherein the internal lever is L-shaped and connects a central point in the mouthpiece portion to a point near an edge of the main body portion.

11. The electronic cigarette according to claim 9, wherein the receiving portion comprises an elongate slot which is configured to retain a rotating end of the internal lever while enabling the rotating end to both rotate in the elongate slot and move linearly along the elongate slot.

12. The electronic cigarette according to claim 11, wherein the main body portion is elongate and the elongate slot is at least approximately aligned with an elongate axis of the main body portion such that when the mouthpiece portion moves to the open position the mouthpiece portion both rotates relative to the main body portion and moves linearly away from the main body portion.

13. A kit comprising:

the electronic cigarette according to claim 1;

a first cartridge arranged to be received by the first cartridge seating; and a second cartridge arranged to be received by the second cartridge seating.

14. The kit according to claim 13, wherein the first cartridge comprises an atomizer and a liquid store.

15. The kit according to claim 13, wherein the second cartridge comprises a tobacco substrate.

* * * * *